United States Patent [19]

Uehara et al.

[11] Patent Number: 4,492,268

[45] Date of Patent: Jan. 8, 1985

[54] CONDENSER

[75] Inventors: Haruo Uehara, Saga; Hiroyuki Sumitomo, Osaka, both of Japan

[73] Assignee: Hisaka Works, Ltd., Osaka, Japan

[21] Appl. No.: 295,309

[22] Filed: Aug. 24, 1981

Related U.S. Application Data

[63] Continuation of Ser. No. 76,443, Sep. 17, 1979, abandoned.

[51] Int. Cl.[3] ..... F28F 3/00

[52] U.S. Cl. ..... 165/166; 165/170

[58] Field of Search ..... 165/110, 111, 133, 166, 165/167, 170

[56] References Cited

U.S. PATENT DOCUMENTS

| | | | |
|---|---|---|---|
| 2,596,642 | 5/1952 | Boestad | 165/166 |
| 4,166,498 | 9/1979 | Fujie et al. | 165/133 |
| 4,180,129 | 12/1979 | Sumitomo | 165/110 |

*Primary Examiner*—Samuel Scott
*Assistant Examiner*—Noah Kamen
*Attorney, Agent, or Firm*—Armstrong, Nikaido, Marmelstein & Kubovcik

[57] ABSTRACT

Improvements in the condensing heat transfer surface of a condenser which handles organic working fluids whose surface tension is not more than 35 dyne/cm as gas mediums to be condensed. The improvements comprise the formation of a plurality of transversely spaced vertically extending grooves on the condensing heat transfer surface on which the gas medium condenses. The pitch of the grooves is about 1–2 mm and the depth is about 0.3–0.6 mm.

1 Claim, 6 Drawing Figures

CONDENSER

This is a continuation, of application Ser. No. 076,443, filed Sept. 17, 1979, now abandoned.

BACKGROUND OF THE INVENTION

1. Field of the Invention

The present invention relates to a condenser wherein as a result of heat exchange between two mediums, one gas medium condenses.

2. Description of the Prior Art

There are various types of condensers, including the plate type and the tube type, but a common problem which arises in improving the heat transfer performance is connected with film coefficient which indicates the ease with which heat transfers on the heat transfer surface. Film coefficient is given by (the thermal conductivity of a liquid film divided by the thickness of the liquid film). Therefore, it is determined by the condition of condensate adhering to the heat transfer surface. When this condition of condensate adhering to the heat transfer surface is considered, it will be seen that a downflow liquid film of condensate is formed on the entire heat transfer surface facing a space into which a gas medium, for example, water vapor to be condensed is fed and that such liquid film gradually grows as condensation continues, until it is carried away by its own weight or by the flow of vapor and flows down along the heat transfer surface. Since this downflow liquid layer blocks the contact between the heat transfer surface and the gas medium and its thickness increases progressively as it approaches the bottom of the heat transfer surface, the film coefficient on said heat transfer surface is greatly decreased, thus considerably lowering the heat transfer performance. Therefore, in order to improve the heat transfer performance of the entire heat transfer surface on which a gas medium condenses, it is necessary to prevent the condensate from growing into a thick liquid film covering the entire heat transfer surface.

As for an arrangement which meets this necessity, a heat transfer surface which is formed with flutes or corrugations is known. In such heat transfer surface construction, on the condensing heat transfer surface facing a space into which one medium, for example, water vapor, to be condensed is fed, said one medium is cooled by the other cooling medium, for example, cooling water, producing a condensate which is then collected in the valleys (as seen from the space for the gas medium to be condensed) of the corrugations on the heat transfer surface by the action of surface tension and flows down these valleys, thus preserving the ridges of the corrugations as heat transfer surface portions not covered with thick condensate films. With this heat transfer surface, the ratio of the area of the condensate film flowing down the heat transfer surface is decreased; conversely; the area of the exposed heat transfer surface portion not covered with a thick condensate film is increased, thus improving the heat transfer performance.

SUMMARY OF THE INVENTION

The present invention improves the above described heat transfer surface construction provided with flutes or corrugations. The optimum values for the pitch and depth of corrugations formed on the heat transfer surface depend on the nature of condensate, particularly the surface tension thereof. Grasping this relation, the invention provides a condensing heat transfer surface construction which exhibits its maximum heat transfer performance when treating organic working fluids whose surface tension is not more than 35 dyne/cm.

The invention provides a condenser which handles organic working fluids whose surface tension is not more than 35 dyne/cm as gas mediums to be condensed, wherein the condensing heat transfer surface on which a gas medium condenses is corrugated, having a plurality of transversely spaced vertically extending liquid collecting grooves, whose pitch is 1–2 mm and whose depth is 0.3–0.6 mm. According to the invention, a condensate which forms on the condensing heat transfer surface on which a gas medium condenses is collected in the valleys, namely the liquid collecting grooves, of the corrugations by the action of surface tension and concentratedly flows down said grooves, with the result that the ridges of the corrugations contact the gas medium directly or through a very thin liquid film, so that the heat transfer surface has, in its entirety, a condensate film of greatly reduced thickness, assuring greately improved heat transfer performance.

These and other features of the invention will become more apparent from the following description given with reference to the accompanying drawings.

DESCRIPTION OF THE PREFERRED EMBODIMENTS

Figure 2:
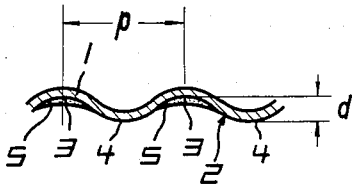
FIG. 2 is a section taken along the line II—II of FIG. 1.
Figure 1:
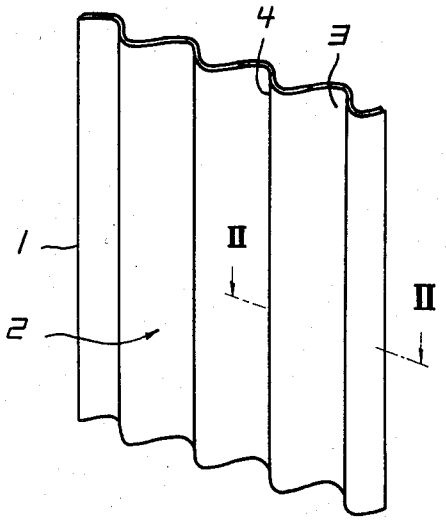
FIG. 1 is a fragmentary perspective view of a heat transfer surface according to the invention.

FIGS. 1 and 2 illustrate, by way of example, an embodiment of the invention applied to a plate type condenser comprising a plurality of heat exchange plate elements 1. Each plate 1 is corrugated and the valleys and ridges as seen from a condensing heat transfer surface 2 on which a gas medium condenses are designated by the numerals 3 and 4, respectively. The condensate in the form of droplets initially formed over the entire area of the heat transfer surface 2 progressively gets together into larger particles before it grows into a thick downflow liquid film, said particles being collected exclusively in the valleys 3 by the action of surface tension as indicated by the numeral 5 and carried away by their own weight and by the flow of gas medium. Thus, the condensate flows down concentratedly along the valleys, namely liquid collecting grooves 3. Accordingly, the ridges 4 of the corrugations contact the gas medium directly or through a very thin liquid film, so that the heat transfer surface 2 has, as a whole, a greately reduced amount of heat transfer surface portion covered with a thick condensate film which is undesirable to heat transfer performance.

Figure 3:
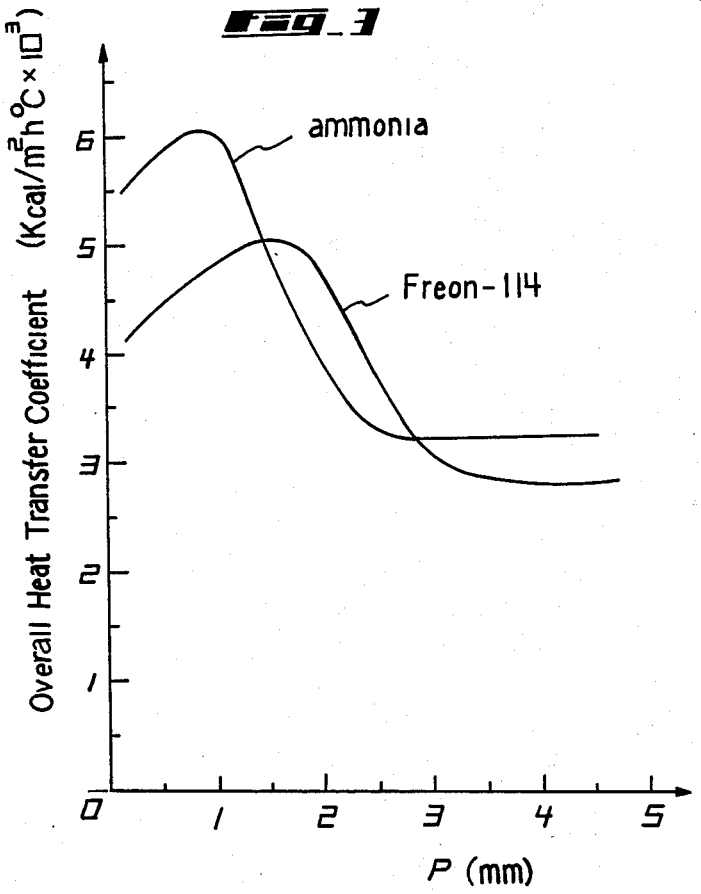
FIG. 3 is a graph showing the relation between the pitch of the corrugations formed on the heat transfer surface and the overall heat transfer coefficient on said heat transfer surface.

On the heat transfer surface 2, the plurality of liquid collecting grooves 3 are transversely spaced and vertically extend. As described above, the optimum values for the pitch p and depth d of the liquid collecting grooves depend on the nature of condensate, particularly its surface tension. The invention is intended to provide a condensing heat transfer surface construction suitable for a condenser which handles organic working fluids whose surface tension is not more than 35 dyne/cm, such as ammonia and Freon 114, as gas mediums to be condensed. In this connection, the surface tension of ammonia is 35 dyne/cm and that of Freon 114 is 15 dyne/cm. As can be understood from FIG. 3 which shows the relation between the pitch p of the liquid collecting grooves 3 and the overall heat transfer coefficient on the heat transfer surface 2 which has been obtained through experiments with ammonia and Freon 114, the optimum value for p is about 1 mm for ammonia and about 1.5 mm for Freon 114. This teaches us that the pitch p of the liquid collecting grooves 3 should be given a greater value for a fluid having a lower surface tension. However, if the pitch p exceeds about 2 mm, the overall heat transfer coefficient begins to decrease. Thus, it is seen that if an organic working fluid whose surface tension is not more than 35 dyne/cm is employed as a gas medium to be condensed, the pitch p of the liquid collecting grooves 3 formed on the condensing heat transfer surface should suitably be about 1–2 mm.

The depth d of the liquid collecting grooves 3 has a close connection with the pitch p, as described above, and for organic working fluids whose surface tension is not more than 35 dyne/cm, it has been found that the depth d is suitably about $\frac{5}{8}$ of the pitch p or, concretely, about 0.3–0.6 mm.

While the invention has so far been described as applied to a plate type condenser, it is not limited to the plate type and it is equally applicable to condensing heat transfer surfaces in other types of condensers including the tube type.

In the heat transfer surface construction provided with flutes or corrugations described above, in the case of the plate type it would be necessary to install suitable spacers at the required places on the heat transfer surfaces in order to maintain a suitable spacing between adjacent plates. This is because placing adjacent plates with their ridges in butted relation to each other would result in the reduction of the areas of the ridges and hence the effective heat transfer surface area, thus lowering the condensing performance. Therefore, it is not desirable from the standpoint of strength and pressure resistance to rely only on such spacers for supporting the plates and maintaining the spacing therebetween. Further, if an organic working fluid whose specific volume is smaller than water vapor, for example, ammonia and furan, it is necessary to make the cross-sectional area of the space between adjacent plates smaller than in the case of water vapor, which necessarily results in the abutment or at least close adjacency of the ridges as described above, causing the lowering of the condensing performance. A another method, it would be contemplated to employ two kinds of spacers, one for making the gas medium plate spacing smaller and the other for making the liquid medium plate spacing larger, but this would complicate the assembling operation.

Figure 4:
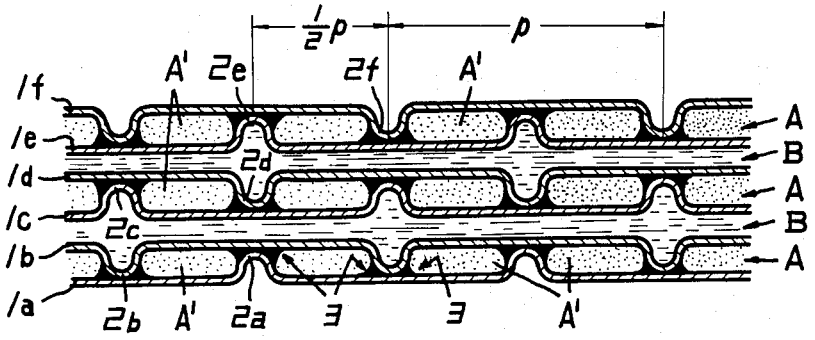
FIG. 4 is a somewhat schematic view, in cross section, of the principal portion of a plate type condenser.
Figure 5:
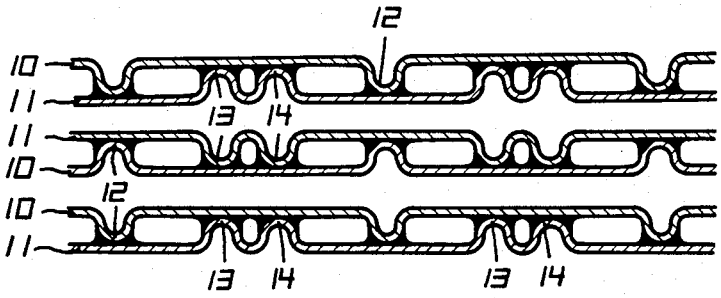
FIG. 5 is a sectional view of a modification of the embodiment shown in FIG. 4.
Figure 6:
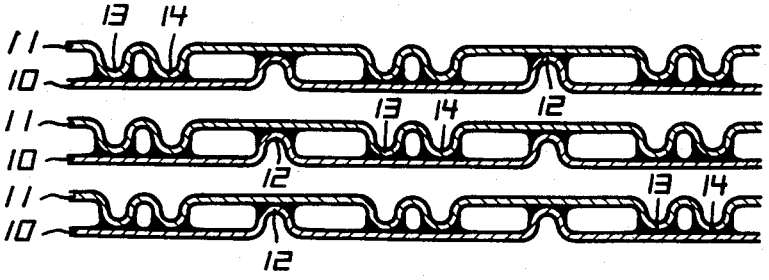
FIG. 6 is a sectional view of another modification of the embodiment shown in FIG. 4.

FIGS. 4 through 6 show an embodiment of a plate type condenser designed to solve these problems. This condenser comprises a plurality of vertically extending plate elements put together to define spaces therebetween for two mediums to be subjected to heat exchange, each plate being formed with a plurality of transversely spaced vertically extending ridges which project into the spaced assigned to the gas medium to be condensed and abut against the surface of the opposed adjacent plate. The resulting condensate concentratedly flows down adjacent the regions where the ridges abut against the plate surfaces, said ridges serving as spacers for maintaining the spacing between adjacent plates and also serving to reinforce the plates. According to such arrangement, the plates are given an increased strength and an increased resistance to pressure, and treatment in large quantities becomes possible. Further, the collection of condensate and the discharge of condensate from the heat transfer surfaces are also improved and hence the heat transfer performance is improved. Further, by suitably selecting and combining the height, width, pitch and number of ridges, the cross-sectional area of the space between the plates for mediums can be adjusted to the nature of the fluid medium to be handled. This advantage is noticeable particularly when ammonia, furan or other effective working fluids are used as gas mediums.

In FIG. 1, the plate type condenser comprises a plurality of plate elements 1*a*–1*f*, and between them are defined spaces A for a gas medium to be condensed which is one of two mediums to be subjected to heat exchange, said spaces A alternating with spaces B for the other cooling medium. Each of the plates 1*a*–1*f* is provided with a plurality of ridges 2*a*–2*f* (which are integral with each other, in the illustrated example) which are transversely spaced and vertically extend. In each plate, the ridges project into the space A for the medium to be condensed, and in each pair of adjacent plates, the ridges on each plate are displaced a suitble amount ($\frac{1}{2}$ pitch, in the illustrated example) so that they abut against the flat surface portions of the opposed plate. In this manner, the ridges 2*a*–2*f* divide the spaced A into a plurality of small sections A'. In other words, the cross-sectional area of the space A is reduced by an amount corresponding to (the cross-sectional area x the number of ridges), while the cross-sectional area of the space B is increased by that amount. This is advantageous when the gas medium to be condensed is an organic working fluid whose specific volume is small, such as ammonia or furan. Further, in this type of condenser where a gas medium is cooled for condensation by a liquid medium, the pressure of the liquid medium is higher than that of gas medium, so that the pressure difference acts in a direction to compress the gas medium spaces A, tending to damage the plates. However, in the emodiment described above, the ridges 2*a*–2*f* prevent such damage and serve to increase pressure resistance and strength, assuring that the condenser has an increased capacity for treatment.

In the arrangement of FIG. 4, the gas medium fed to the spaces A flows down along the surfaces of the vertical plates and condenses through heat exchange through the plate walls with the cooling medium fed to the adjoining spaces B. The resulting condensate is drawn by the action of surface tension to the corners between the ridges 2*a*–2*f* and the surface of the plates 1*a*–1*f* against which they abut, and flows down exclusively along said corners. Therefore, in the condensing heat transfer surfaces on which the gas medium condenses, the proportion of the heat transfer surface portions not covered with a downflow liquid films which prevent said heat transfer surfaces from contacting the gas medium is increased, assuring effective collection of condensate and effective discharge thereof from the heat transfer surfaces, thus improving the heat transfer performance of the condenser.

In an embodiment shown in FIG. 5, the condenser comprises plates 10 each having ridges 12 arranged one by one at equal intervals and plates 11 each having ridges 13 and 14 arranged two by two at equal intervals. This arrangement further improves the effect obtained in the embodiment of FIG. 4.

The plates shown in FIG. 6 are of the same shape as those shown in FIG. 5 but are different from the preceding embodiment in that they are simply alternately arranged in the same direction. The function and effect are substantially the same as those described above.

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A plate-type condenser adapted to handle organic working fluids whose surface tension is not more than 35 dyne/cm as gas mediums to be condensed comprising a plurality of heat transfer plates each of which consists substantially of transversely spaced vertially extending grooves with intervening ridges, said plate elements being put together to define therebetween alternate spaces for a cooling medium and for a medium to be condensed, the ridges of adjacent plate elements extending into the spaces for the medium to be condensed and abutting the adjacent plate element in between opposed ridges of the adjacent plate element, whereby the cross-sectional area of the spaces for the medium to be condensed are smaller than the cross-sectional area of the spaces for the cooling medium, and in which the space vertically extending grooves in the condensing areas have a pitch and depth of 1–2 mm and 0.3 to 0.6 mm respectively.

* * * * *